US009808853B2

(12) United States Patent
Frenken

(10) Patent No.: US 9,808,853 B2
(45) Date of Patent: Nov. 7, 2017

(54) JAW PAIR FOR PUNCHING OUT HOLES

(75) Inventor: Egbert Frenken, Heinsberg (DE)

(73) Assignee: GUSTAV KLAUKE GMBH (DE)

( * ) Notice: Subject to any disclaimer, the term of this patent is extended or adjusted under 35 U.S.C. 154(b) by 396 days.

(21) Appl. No.: 14/235,879

(22) PCT Filed: Jul. 27, 2012

(86) PCT No.: PCT/EP2012/064753

§ 371 (c)(1),
(2), (4) Date: May 15, 2014

(87) PCT Pub. No.: WO2013/017535

PCT Pub. Date: Feb. 7, 2013

(65) Prior Publication Data

US 2014/0251104 A1 Sep. 11, 2014

(30) Foreign Application Priority Data

Aug. 2, 2011 (DE) ..... 10 2011 052 350

(51) Int. Cl.
*B21D 45/00* (2006.01)
*B21D 28/26* (2006.01)
(Continued)

(52) U.S. Cl.
CPC ..... *B21D 45/006* (2013.01); *B21D 28/26* (2013.01); *B21D 28/34* (2013.01); *B26D 7/1818* (2013.01);
(Continued)

(58) Field of Classification Search
CPC . B21F 1/12; B21F 1/34; B26D 7/1818; B21D 28/26; B21D 28/34; B21D 45/006
See application file for complete search history.

(56) References Cited

U.S. PATENT DOCUMENTS 1,822,468 A * 9/1931 Wales ..... B21D 45/006 279/89
2,624,940 A * 1/1953 Osborne ..... B26F 1/12 30/131
(Continued)

FOREIGN PATENT DOCUMENTS

DE 19934288 C1 7/1999
DE 102005028083 A1 2/2006
(Continued)

OTHER PUBLICATIONS

International Search Report for PCT/EP2012/064753 dated Feb. 7, 2013.

*Primary Examiner* — Liang Dong
(74) *Attorney, Agent, or Firm* — Klintworth & Rozenblat IP LLP

(57) ABSTRACT

The invention relates to a jaw pair for punching out holes or recesses, preferably in sheet metal parts, the jaw pair being connectable to a device (23) to be operated preferably hydraulically and being designed, for example, as a pivoting jaw pair, wherein a punch (8) is formed on one jaw and a punching opening (6) is formed on the other jaw. To provide an advantageous jaw pair for punching out holes or recesses, preferably in sheet metal parts, it is proposed that a stripper part (10) which is situated outside of an outer contour of the punch (8) in the punching direction is formed in the jaw having the punch (8) and is movable in relation to the punch (8).

20 Claims, 9 Drawing Sheets

(51) Int. Cl.

| | |
|---|---|
| ***B21D 28/34*** | (2006.01) |
| ***B26D 7/18*** | (2006.01) |
| ***B26F 1/12*** | (2006.01) |
| ***B26F 1/34*** | (2006.01) |

(52) U.S. Cl.
CPC ..... *B26F 1/12* (2013.01); *B26F 1/34* (2013.01); *Y10T 83/2159* (2015.04)

(56) References Cited

U.S. PATENT DOCUMENTS

| | | | | | |
|---|---|---|---|---|---|
| 3,296,905 | A | * | 1/1967 | Killaly | B21D 45/006 83/140 |
| 3,461,762 | A | | 8/1969 | Deni et al. | |
| 3,924,330 | A | | 12/1975 | Mitsuhashi et al. | |
| 4,571,975 | A | * | 2/1986 | Pawloski | B21D 39/034 137/625.68 |
| 4,993,295 | A | * | 2/1991 | Dacey, Jr. | B21D 45/006 83/140 |
| 5,806,362 | A | | 9/1998 | Dubugnon | |
| 6,206,663 | B1 | | 3/2001 | Frenken | |
| 6,247,515 | B1 | | 6/2001 | Spatafora | |
| 6,276,186 | B1 | | 8/2001 | Frenken | |
| 6,718,870 | B1 | | 4/2004 | Frenken | |
| 7,216,523 | B2 | | 5/2007 | Frenken | |
| 7,412,868 | B2 | | 8/2008 | Frenken | |
| 2005/0011236 | A1 | | 1/2005 | Frenken | |

FOREIGN PATENT DOCUMENTS

| | | | | | |
|---|---|---|---|---|---|
| DE | 19854943 | | | 5/2010 | |
| DE | 202010015154 | U1 | | 7/2011 | |
| DE | 102010036482 | A1 | | 1/2012 | |
| EP | 1491295 | B1 | | 9/2006 | |
| EP | 1084798 | B1 | | 6/2009 | |
| FR | 2707539 | A1 | * | 1/1995 | B21D 28/243 |
| JP | 50 066292 | U | | 6/1975 | |
| WO | 9904165 | | | 1/1999 | |
| WO | 9919947 | A1 | | 4/1999 | |
| WO | 03084719 | A2 | | 10/2003 | |

* cited by examiner

JAW PAIR FOR PUNCHING OUT HOLES

FIELD OF THE INVENTION

The invention relates to a jaw pair for punching out holes or recesses, preferably in sheet metal parts, formed as a pivoting jaw pair, for example, the jaw pair being connectable to a device to be operated preferably hydraulically, and a punch being formed on one jaw and a punching opening being formed on the other jaw.

BACKGROUND OF THE INVENTION

Such jaw pairs are already known in various respects. Reference is made to DE 199 34 288 C1 and U.S. Pat. No. 6,427,515 B1, for example.

In addition, hydraulically operated devices on which such a jaw pair can be mounted are known in various embodiments. Reference is made in this regard to WO 99/04165 A1 and U.S. Pat. No. 6,206,663 B1, DE 198 54 943 A1, WO 99/19947 A1 and U.S. Pat. No. 6,276,186 B1, EP 1 084 798 A2 and U.S. Pat. No. 6,718,870 B1, and WO 03/084719 A2 and U.S. Pat. No. 7,412,868 B2.

With regard to the known punching device, a favorable operation is the goal. After the punch has broken through, there is sometimes jamming of sheet metal or other parts from which punching-out has taken place.

SUMMARY OF THE INVENTION

Against this background, it is an object of the invention to provide an advantageous jaw pair for punching out holes or recesses, preferably from sheet metal parts.

According to a first inventive concept, one possible approach to this object is obtained with subject matter in which a stripper part situated outside of an outer contour of the punch in the punching direction, and movable in relation to the punch, is formed on the punching jaw having the punch. With such a jaw pair, in which one or both jaws execute(s) a movement in relation to the device in the course of performing a punching operation, this stripper part achieves the result that jamming of the device in the sheet metal part, for example, or entrainment of the sheet metal part on the jaw of the jaw pair having the punch after the end of the punching operation, can be counteracted. A sequence of punching operations can then be performed efficiently one after the other without hindrance.

Additional features of the invention are explained below and illustrated in the description of the figures and in the accompanying drawings, often in their preferred association with the concept already described above, but they may also be of importance in association with only one or more individual features, which are described or illustrated here, or independently, or in another overall concept.

It is thus preferable that the stripper part is biased into a position at least partially protruding beyond the punch at its free end. This bias makes it possible for the stripper part to move backward when the jaws come together, when the stripper part initially comes to rest on the workpiece, until the punch acts on the workpiece. Also in the course of this action, the stripper part initially moves farther backward, corresponding to the position of the punch in relation to the workpiece into which it is penetrating and/or through which it penetrates. After the end of the punching operation, when the jaws are moving apart again, the stripper part resting on the (remaining) workpiece assists the movement of the punch away from the workpiece. Unless the bias force is exceeded, the workpiece is reliably lifted off the punch.

The stripper part may fundamentally be designed, for example, in the form of a plurality of stripper rods arranged preferably symmetrically and with equal circumferential spacing around the punch. However, a sleeve-like design of the stripper part is preferred. In this design, any remaining small parts are also reliably pushed back and ultimately stripped off when the jaws are opened.

It is also preferred that the bias of the stripper part is achieved by a mechanical spring, in particular a helical spring. The helical spring may be formed to surround a stationary securing part and/or a mount of the punch. One possibility is a circular securing part, which is accordingly surrounded by a helical spring extending in the manner of a cylindrical surface.

As an alternative to the formation of the jaw pair as a pivoting jaw pair, the jaw pair may also be formed as a sliding jaw pair. It has advantageously been found that the punch and the punching opening move parallel to one another, with coinciding central axes, in contrast to a movement on the (same) arc in the case of a pivoting jaw pair.

In another configuration of a sliding jaw pair, it is preferably provided that the punch jaws are accommodated in mutually displaceable mounts, and these mounts have a shared connecting fitting to the device. In particular with respect to a hydraulically operated device, this connecting fitting then also has the required hydraulic interface. The movement apparatus of the jaws of the sliding jaw pair is preferably provided on the jaw side of the connecting fitting. In this embodiment, the sliding jaw pair, which is exchangeably connectable to such a device, is provided together with the movement apparatus, preferably hydraulic, for the displacement of the jaws in relation to one another.

It is preferable in particular that the movement apparatus is a hydraulic piston/cylinder mechanism.

It is further preferable that the cylinder is movable, but the piston is stationary. It is likewise preferable that one jaw, more preferably the jaw having the punch, is stationary in relation to the device during a punching operation in the case of the sliding jaw pair, whereas the other jaw, preferably the jaw having the punching opening, is displaced in relation to the device. For an elongated device, as is also preferred in this context, the displacement is preferably carried out transverse to a longitudinal axis of the device, more preferably at right angles to the longitudinal axis of the device.

It is preferable that the movable cylinder part has an end which can be acted upon by hydraulic means and cooperates with the stationary piston part, and has a dry portion which extends beyond a bottom area of the piston part in the open position of the jaws and is similarly carried along when a punching stroke is performed, and which accordingly comes into partial overlap with the piston when the punching stroke is performed. The return spring, which causes the jaws to move back into their starting position after the hydraulic pressure is released, is preferably accommodated in the dry portion.

It is also preferable that one of the jaws, i.e., the jaw having the punch or the jaw having the punching opening, is fixedly connected to the stationary part or to the movable part of the movement apparatus.

The ranges and value ranges given above and in particular below also include all the intermediate values with regard to the disclosure, in particular in one-tenth increments of the stated dimension, optionally also dimensionless, for example, 1/10 degree, 1/10 diameter, etc., on the one hand to delimit the specified range limits from above and/or from below, or alternatively or additionally, also with regard to the disclosure of one or more individual values from a respective stated range.

BRIEF DESCRIPTION OF THE DRAWINGS

The invention is explained in greater detail below with reference to the appended drawings, which, however, merely represent exemplary embodiments, in which.

DETAILED DESCRIPTION OF THE ILLUSTRATED EMBODIMENTS

A first embodiment of a hydraulic pressing device 1 having a jaw pair, formed here as a sliding jaw pair, is described and illustrated in first instance with reference to FIGS. 1 through 6.

Figure 3:
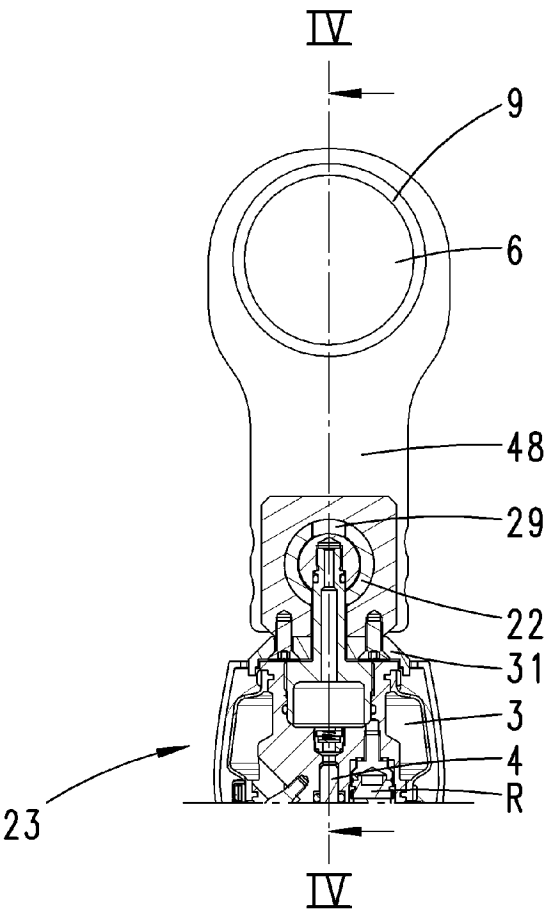
FIG. 3 shows a cross section of the subject matter according to FIG. 2, in a sectional view along line III-III.
Figure 2:
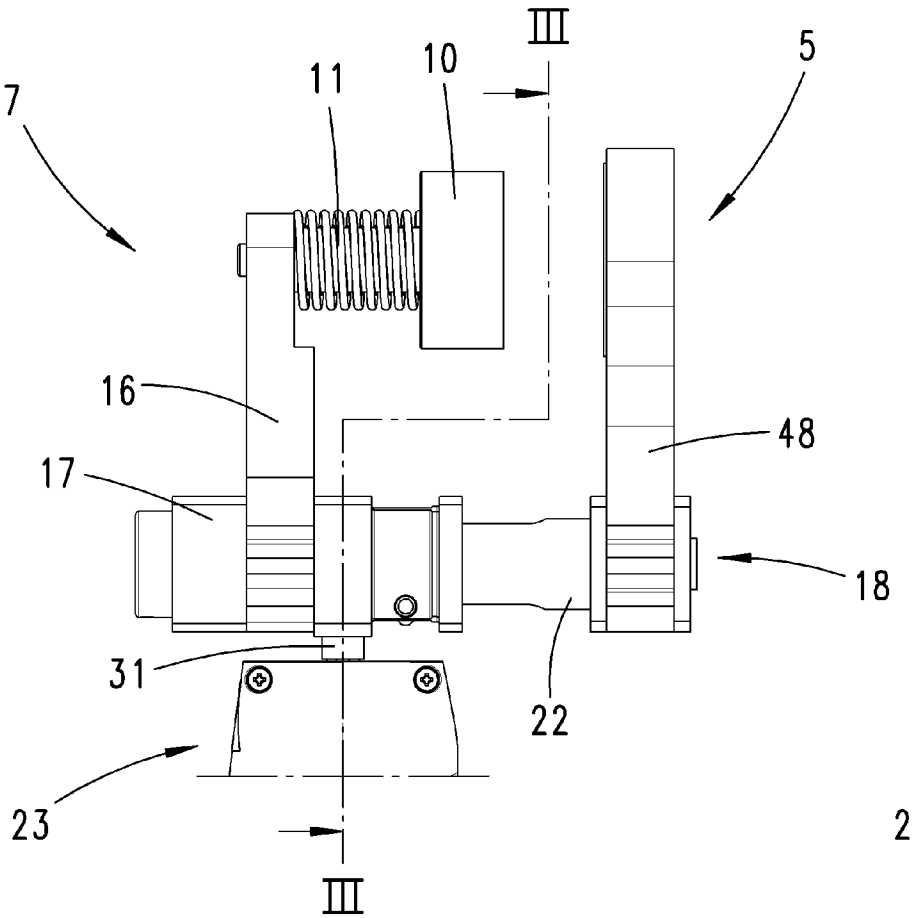
FIG. 2 shows a side view of the device according to FIG. 1, in the upper region.
Figure 5:
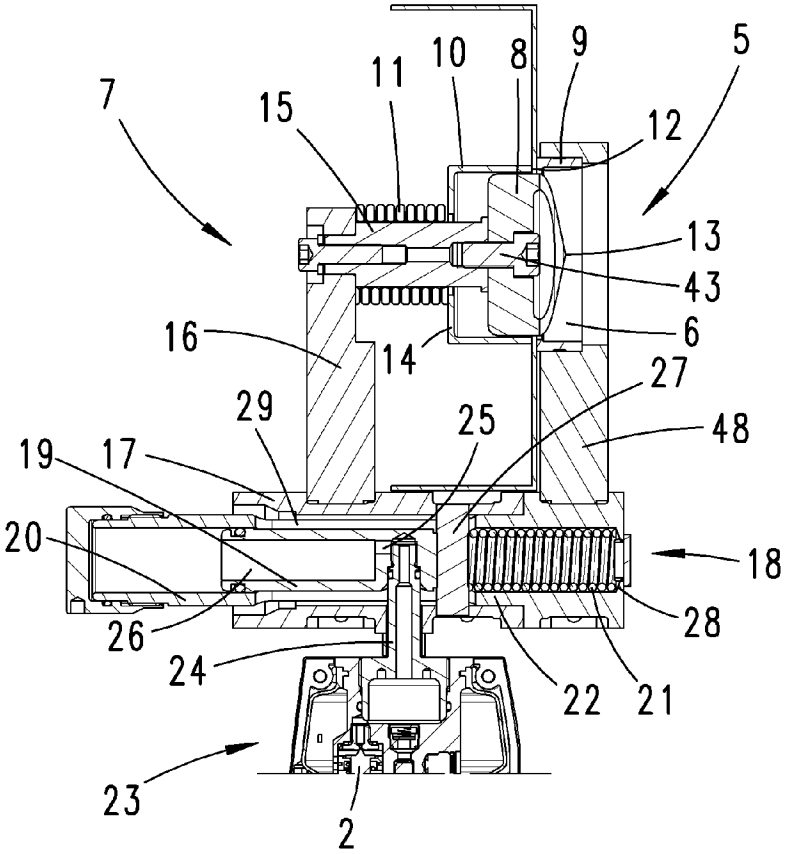
FIG. 5 shows an illustration according to FIG. 4 of the jaws, in the moved-together state in the course of a punching operation.
Figure 4:
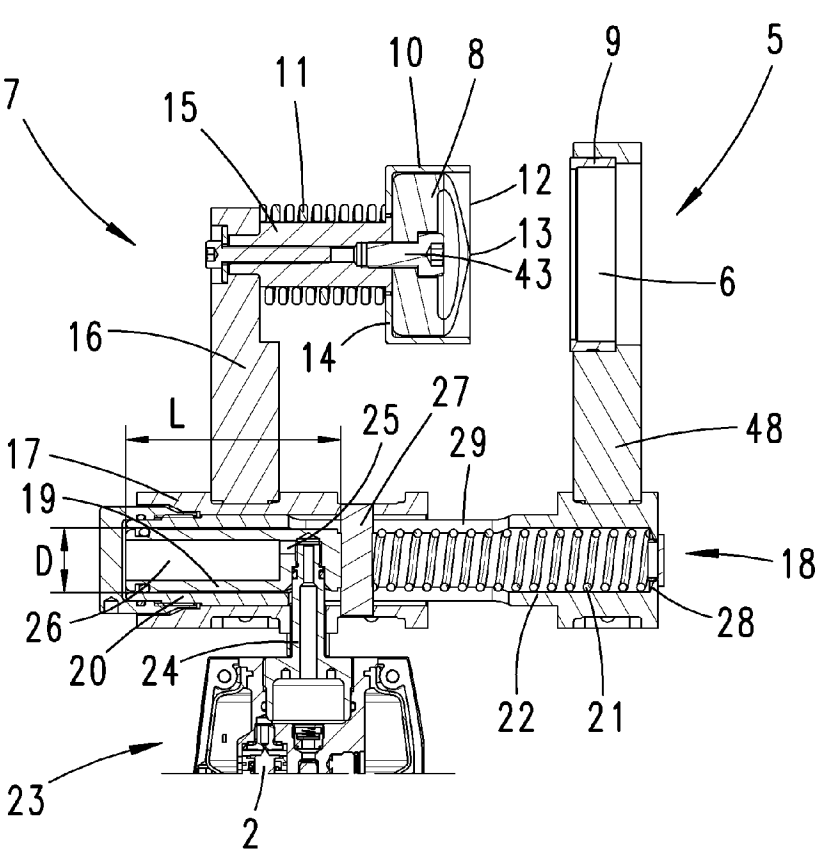
FIG. 4 shows a cross section of the subject matter according to FIG. 2 and FIG. 3, in a sectional view in the plane IV-IV in FIG. 3.
Figure 6:
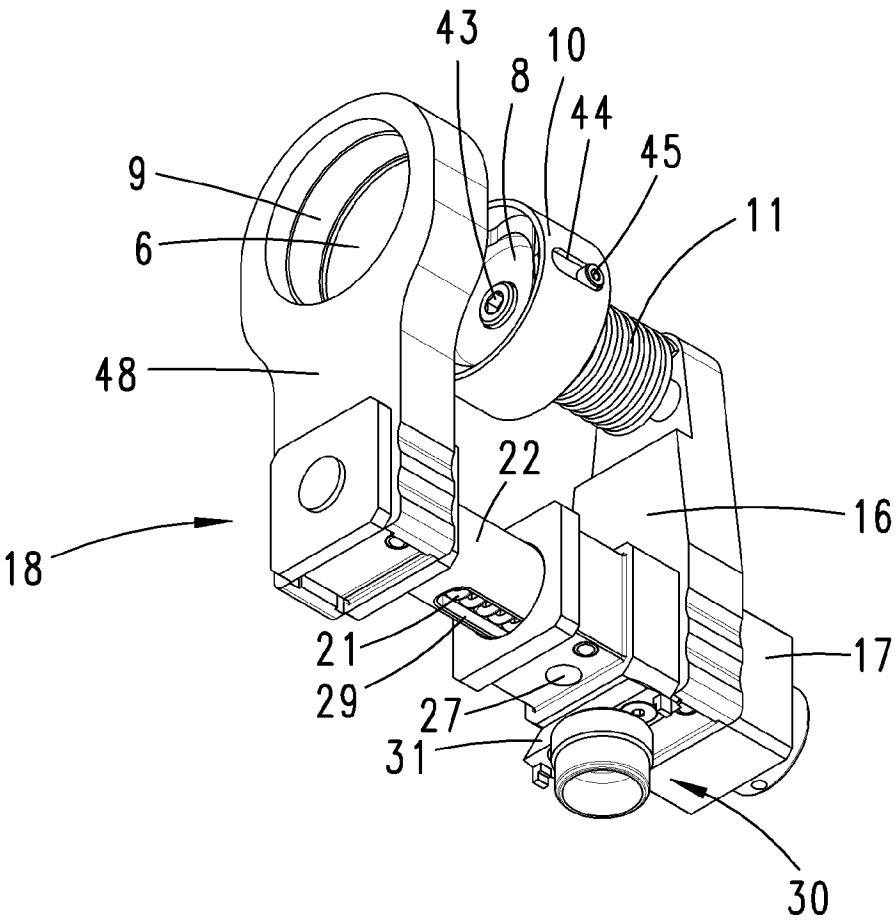
FIG. 6 shows a perspective view of the jaw pair obliquely from below, mounted on the device according to FIG. 1.

The hydraulic pressing device in the exemplary embodiment is a pressing device, such as that also illustrated and described in the cited WO 03/084719 A2 (U.S. Pat. No. 7,412,868 B2). With reference to FIGS. 3 to 5, for example, the relationship to the subject matter described in the aforementioned WO document can be seen in the upper region, for example with respect to the return valve 2, the tank 3 and the pump ram 4. In other respects, reference is made to the full content of the cited WO and US documents for further explanation of the hydraulic device which is preferably used here, also for the purpose of incorporating features described in the WO and US documents with regard to the design of the device into claims of the present patent application.

The jaw pair of the first embodiment is explained in further detail with respect to FIGS. 2 to 6.

A first jaw 5 has a punching opening 6 and the second jaw 7 has the punch 8.

In further detail, as shown in FIG. 4, for example, the punching opening 6 is formed by a punch insert 9, which may be a metal ring part hardened by a suitable method, for example.

The punch 8 in the exemplary embodiment is formed so that it is circular in plan view, so that the punching opening 6 is also accordingly circular in plan view.

Figure 1:
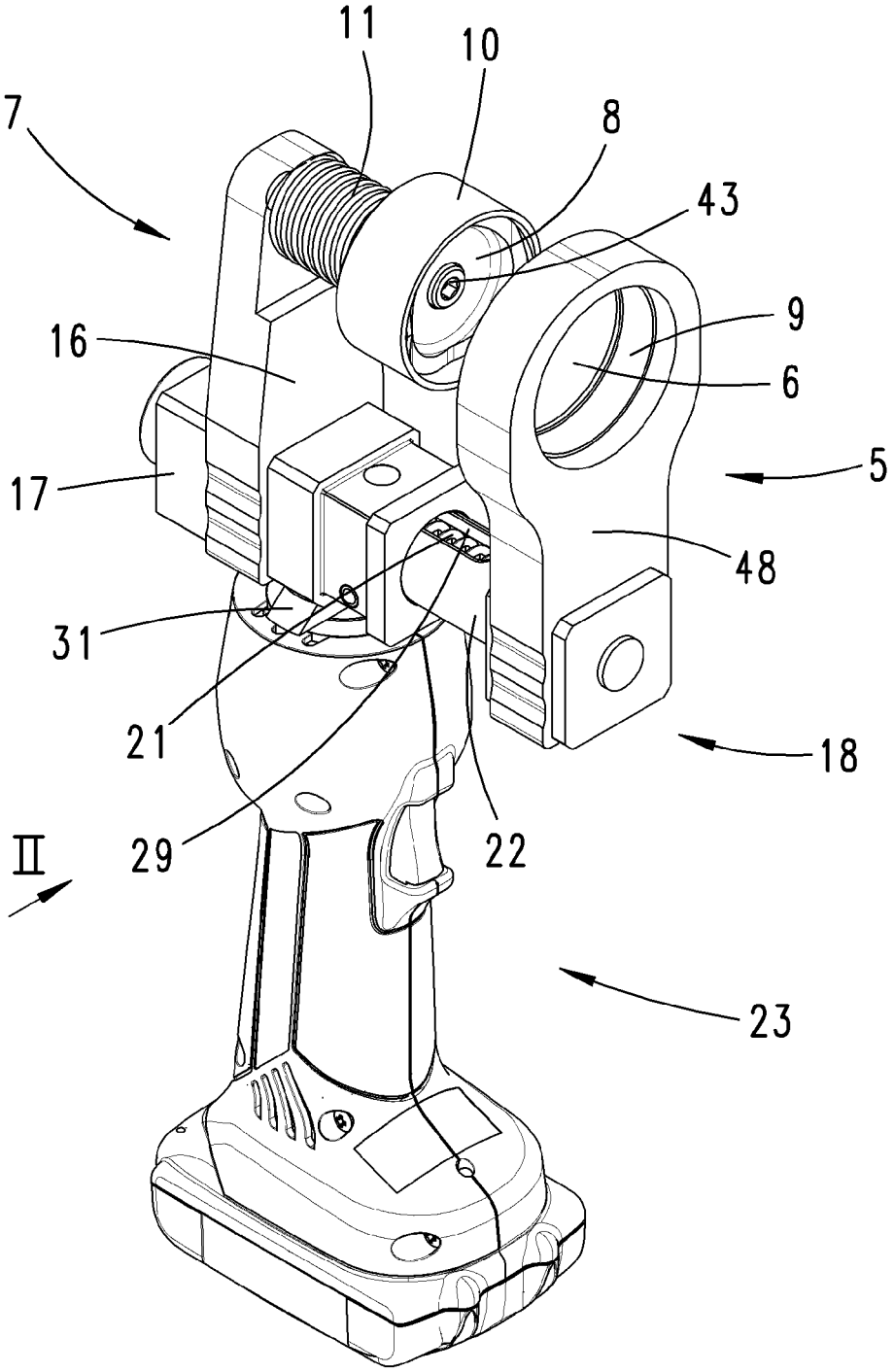
FIG. 1 shows a perspective view of a device having a mounted sliding jaw pair.

An angular design is also possible, such as that known from DE 10 2010 036 482 A1 (cf. FIG. 1 therein).

The punch 8 is surrounded by a stripper part 10, which is movable in relation to the punch 8 against the action of the compression spring 11 in the exemplary embodiment.

As shown in particular by a comparison of FIGS. 4 and 5, a front bordering edge 12 of the stripper part 10 is preferably formed overall as a sleeve in the exemplary embodiment and is arranged so that it is flush with one or more of the punch tips 13 formed on the punch 8 or also protrudes beyond them. The punch tips 13 are preferably formed on the edge, based on a contour outline of the punch 8. However, the stripper part 10 with its front bordering edge in the starting position may also be arranged so that it is set back in relation to a front region of the punch 8, in particular with respect to a punch tip 13. The punch may be formed with a profile in its front surface, as described, while the stripper part preferably extends with its front edge in a plane extending perpendicular to the punching direction.

In the exemplary embodiment, the stripper part 10 also has a bottom portion 14 with which it engages behind the punch 8. In this regard, a form-fitting mount is also achieved to prevent pulling off in the forward direction beyond the punch 8.

The punch 8 is also secured to a mount part 15 which extends in the punching direction and forms a support. This mount part 15 is preferably cylindrical in the exemplary embodiment. The compression spring 11 surrounds the mount part 15, preferably configured as a helical spring.

The mount part 15 is in turn secured at its foot at its end facing away from the punch 8, on a securing part 16 extending at an angle to the mount part 15. In the exemplary embodiment and preferably, the securing part 16 extends at right angles to a longitudinal axis of the mount part 15.

By means of the securing part 16, the punch 8 is ultimately secured on the sliding device 18, preferably on a housing 17 of the sliding device 18 of the jaw pair.

The jaw having the punching opening 6 merges directly into a mount 48, in a manner of speaking.

In further detail, the sliding device 18 comprises a piston part 19 and a cylinder part 20, and further comprises a return spring 21.

The piston part 19 and the cylinder part 20 are accommodated concentrically with respect to one another in the housing 17. A receptacle 22 in which the return spring 21 is accommodated is formed in an extension of the cylinder part 20. The cylinder part 20 and the receptacle 22 are formed in one piece or are connected for movement together.

Whereas the piston part 19 is stationary in relation to the device 23 when operated, as is also the case for the housing 17, the cylinder part 20 moves together with the receptacle 22. To this end, hydraulic fluid is pumped out of the device 23 and into the piston part 19 through a connecting line 24, forming a hydraulic connection, for which purpose in particular a bottom borehole 25 of the piston part 19 is connected to the connecting line 24.

In further detail, the piston part 19 is designed in the form of an elongated cylindrical part having, in its interior, a recess 26, which is also cylindrical, as can be seen here. The elongated design of the piston part 19, wherein the length L of the piston part preferably corresponds to approximately two to five times the diameter D of the piston part, ensures stable guidance of the cylinder part 20 which is movable in relation thereto.

Furthermore, it is apparent that the housing 17 has a cross bolt 27 which at the same time also forms a support for the return spring 21 at one end. At the other end, the return spring 21 is supported on a base 28 of the receptacle 22. With respect to the cross bolt 27 or a location of the housing 17 in this regard, the piston part 19 and the return spring 21 extend in opposite directions.

The jaws are secured directly on the housing 17 by means of the securing part 16 and the mount 48, and are thus stationary with respect to the device 23 in the connected state; i.e., the jaws are secured on the receptacle 22 by means of the mount 48. The jaws are fixedly secured. The securing part 16 and the mount part 48 cannot move in relation to the housing 17 and the receptacle 22, respectively. The described mounts of the jaws, which are connected to one another by means of the sliding device 18, together with the sliding device 18, are also connected or can be connected to the device 23 by means of a shared connecting fitting 30. The piston/cylinder unit of the sliding device 18 is formed on the jaw side of the connecting fitting 30.

As a result of pressurized filling of the recess 26 with hydraulic fluid, the cylinder part 20 is moved out of the position according to FIG. 4 into the position according to FIG. 5. Since the receptacle 22 is also moved in this way, the return spring 21 is correspondingly compressed and biased.

The cross bolt 27 is arranged in a portion of the housing 17 which extends beyond the piston bottom with respect to the connecting line 24, and engages through two oppositely situated elongated holes 29 in the receptacle 22.

The connecting line 24 is part of the connecting fitting 30 (also see FIG. 6), which permits an operationally detachable connection of the unit of the jaws and the sliding device from the device 23. The connecting fitting 30 can be screw-connected to the device.

In particular, the connecting fitting accordingly comprises the mechanical adapter, the screw connection, for example, and a cavity which merges into the connecting line 24 for conducting hydraulic fluid into and out of the piston part 19. The connecting fitting 30 at the same time provides, via a neck-shaped configuration, that the mentioned unit of the jaws and the sliding device is at a distance from a facing end face of the device 23. However, as in the exemplary embodiment, the connecting fitting is preferably screwed into this end face of the device 23 with the foot region having the threaded mechanism.

In addition, the jaw mechanism which is connected to the device 23 is supported overall on the device 23 by means of an attachment part 31 having an elongated shape. The attachment part 31 extends transversely with respect to a displacement direction of the jaws.

The further embodiment having pivoting jaws is explained with reference to FIGS. 7 to 13.

The pivoting jaws 32, 33 are connected in a pivot joint 34. Beginning with the pivot joint, the pivoting jaws 32, 33 on the device side are fundamentally configured in the same way as described in DE 10 2005 028 083 A1 and U.S. Pat. No. 7,216,523 B2. In this regard, the disclosure content of this publication is also hereby incorporated in full in the disclosure of the present patent application, also for including features of this previously known document of the present patent application.

The bearing eyes 35, 36 of each of the jaws 32, 33 are configured with different thicknesses as measured in the axial direction of the bearing opening, as also described in the cited document. The bearing eye 35 is approximately three times thicker than the bearing eye 36.

The inside distance between the two bearing eyes 36 and 35 corresponds approximately to the thickness of the bearing eye 35 having the greater thickness. In the mounted state, the jaws are aligned in relation to one another in such a way that the bearing eyes 35, 36 intermesh. The bearing eye 35, having the greater thickness, of the one jaw 33 is correspondingly arranged between the two bearing eyes 35 and 36 of the other jaw 32. Thus, the bearing eyes 36 having the lesser thickness are situated on the outside of the jaw pair thus formed.

The mounting bolt 37 passes through the bearing openings 6 of the two jaws 32, 33 in the mounted state.

Figure 9:
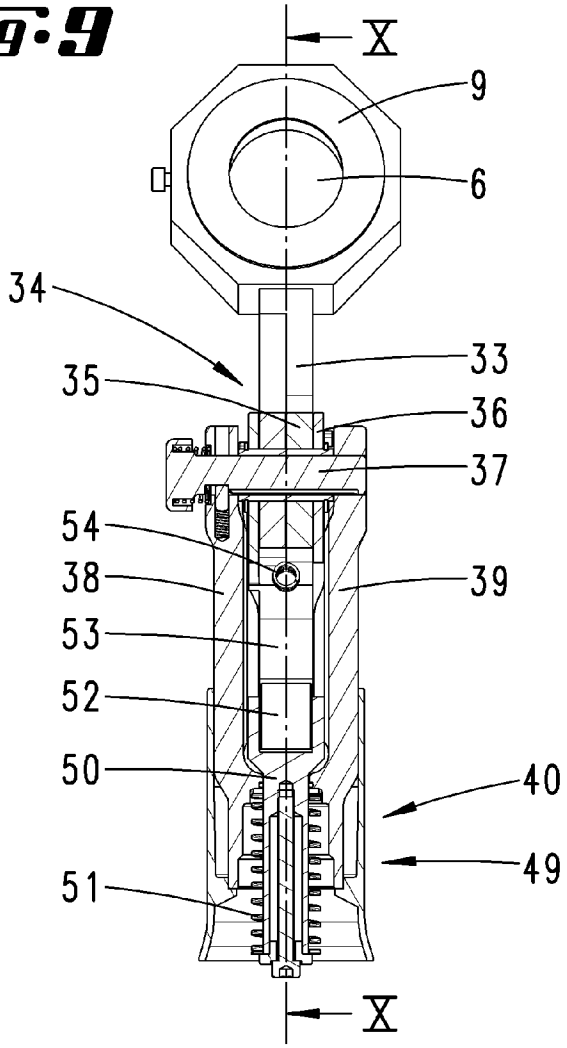
FIG. 9 shows a cross section of the subject matter according to FIG. 8, in a sectional view in the plane IX-IX.

As indicated in further detail from FIG. 9, for example, the locking bolt 37 passes through two arms 38, 39 of the mounting neck 40. The locking bolt 37 may in particular be a bolt such as that known from EP 1 491 295 A1 and US 2005/0011236 A1. In this regard, the content of this document is also hereby incorporated in full in the disclosure of the present patent application, also for the purpose of including features of this document in claims of the present patent application.

Toward the free end, i.e., toward the punch 8, the jaw 32 is formed differently from the jaw 33. The jaw 32 has an angled shape in a side view according to FIG. 8, such that a first jaw portion extends approximately horizontally in the open state of the jaws according to FIG. 7, starting from the pivot joint 34, while a second jaw portion extends approximately vertically. The punch 8 is then held on the other jaw portion, in principle in the same way as already described with respect to the jaw of the first embodiment.

Figure 7:
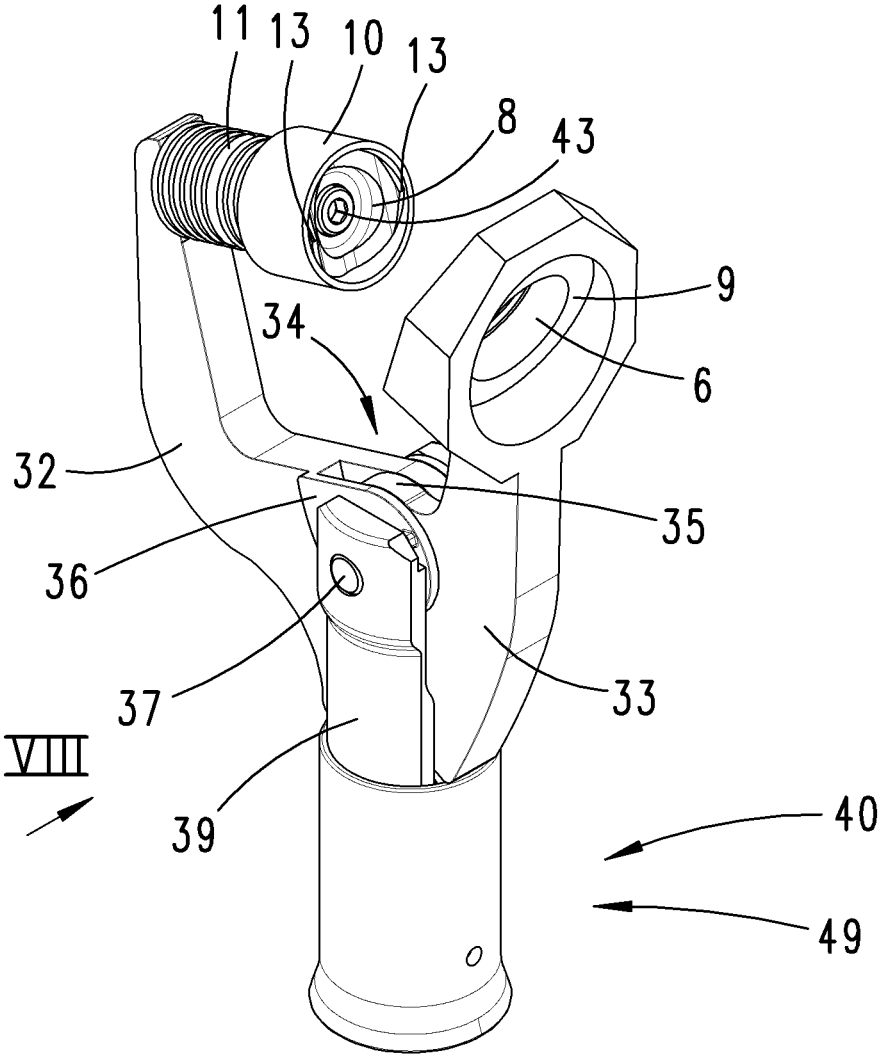
FIG. 7 shows a perspective view of an alternative jaw pair formed as a pivoting jaw pair.
Figure 8:
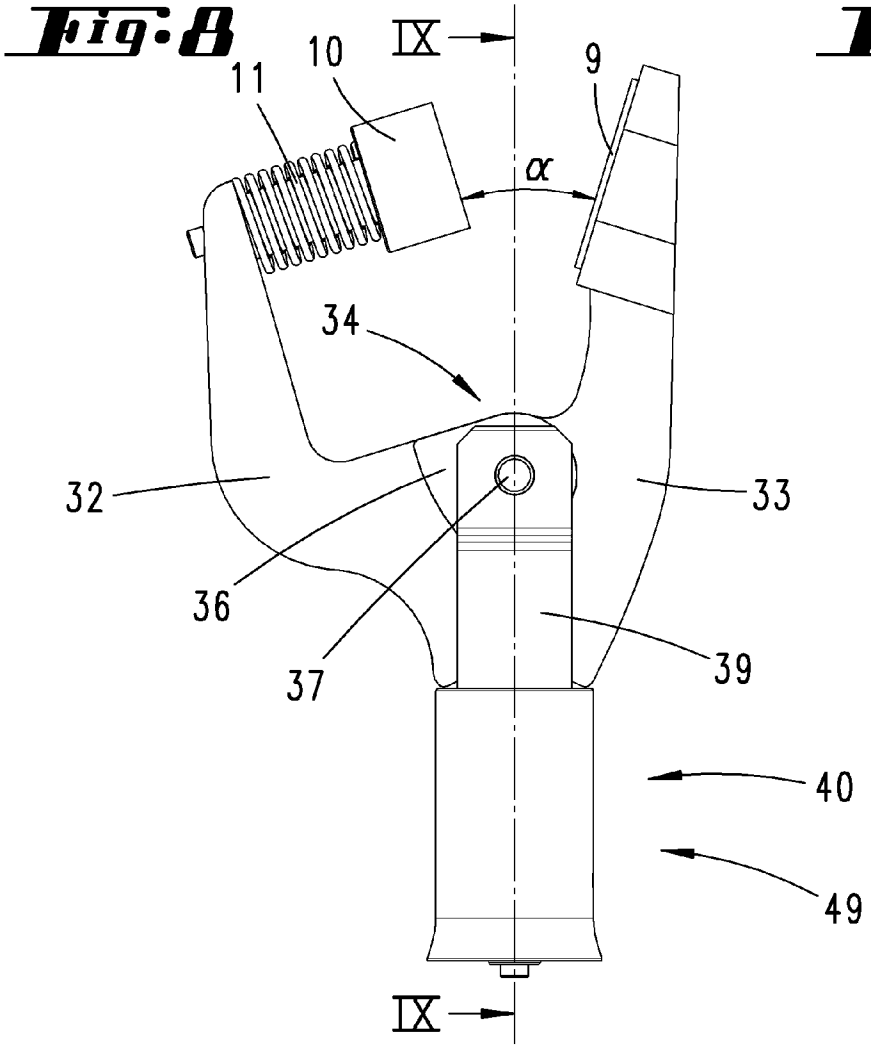
FIG. 8 shows a side view of the jaw pair according to FIG. 7.

In contrast, the second jaw 33 already extends approximately vertically in the position according to FIG. 7 and FIG. 8, the second jaw portion of the jaw 32 and the jaw 33 diverging from one another, forming an angle $\alpha$ of approximately 30° to 60°.

The pivoting jaws of the second embodiment are explained in greater detail with reference to FIGS. 10 to 13.

Figure 11:
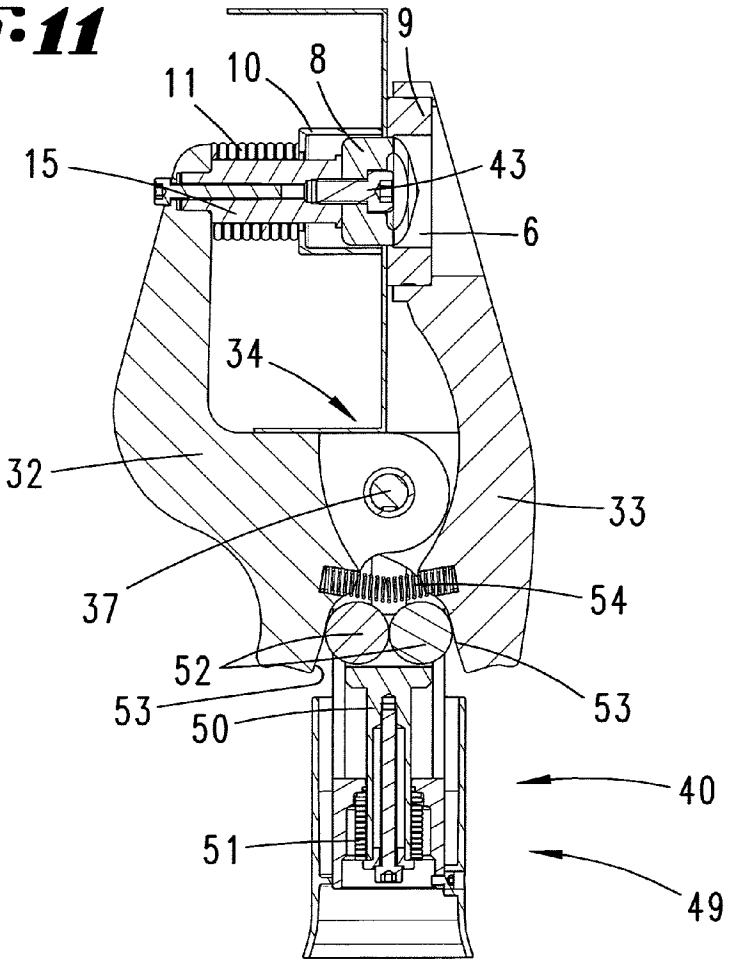
FIG. 11 shows an illustration according to FIG. 10 in the pivoted state, with a punching operation having been performed.
Figure 10:
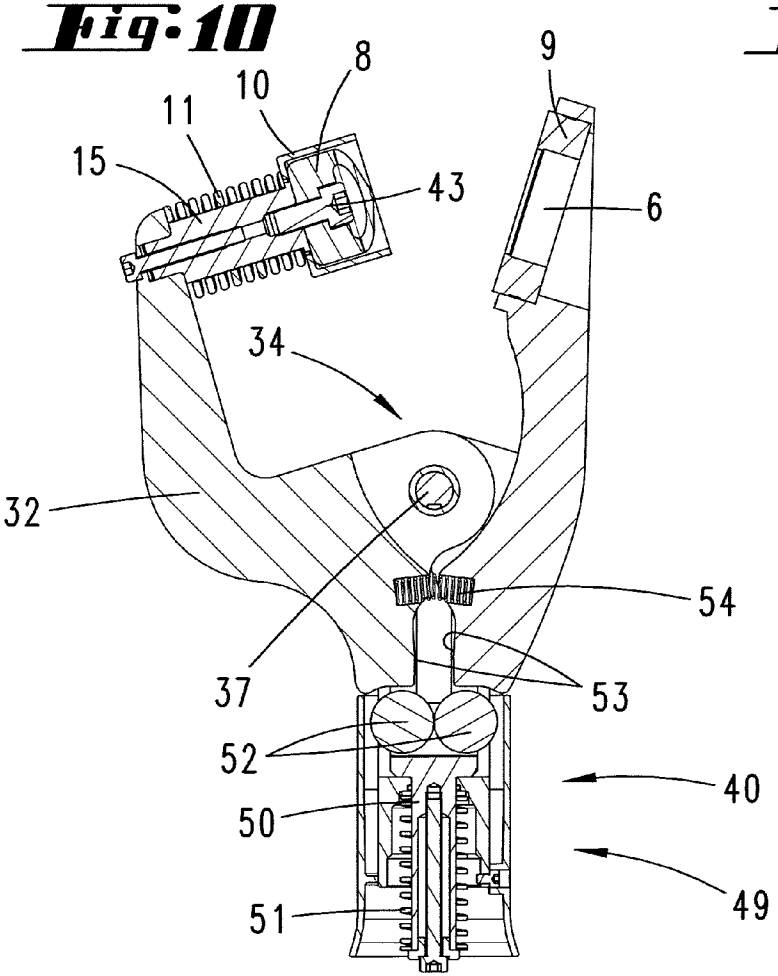
FIG. 10 shows a cross section of the subject matter according to FIG. 8 and FIG. 9, in a sectional view in the plane IX-IX in FIG. 9.

FIGS. 10 and 11 illustrate a connecting fitting of this embodiment. In this regard, it is important that, corresponding to the teaching of EP 1 084 798 A2 and U.S. Pat. No. 6,718,870 B1, a piston shank 50 surrounded by a return spring 51 is already situated in the connecting fitting 49 with respect to the piston/cylinder arrangement formed in conjunction with the device 23. In this embodiment as well, rollers 52 which cooperate with the corresponding acting surfaces 53 of the jaws are accommodated in the connecting fitting 49 on the jaw end of the piston shank 50. In this embodiment, the jaws are further preferably biased into a position, which basically corresponds to the punching position, by a compression spring 54.

FIG. 11 shows the position at the end of a punching operation, the piston 51 being hydraulically displaced by the connected device 23, not shown in greater detail here.

Figure 13:
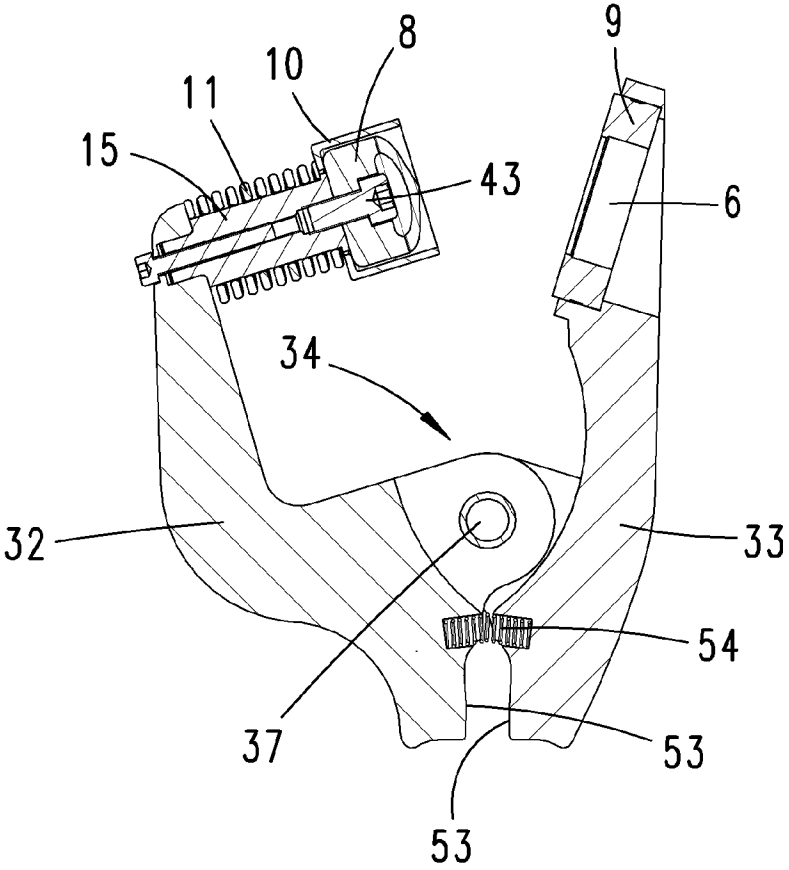
FIG. 13 shows a cross section of the subject matter according to FIG. 12, in a sectional view in the plane XIII-XIII.
Figure 12:
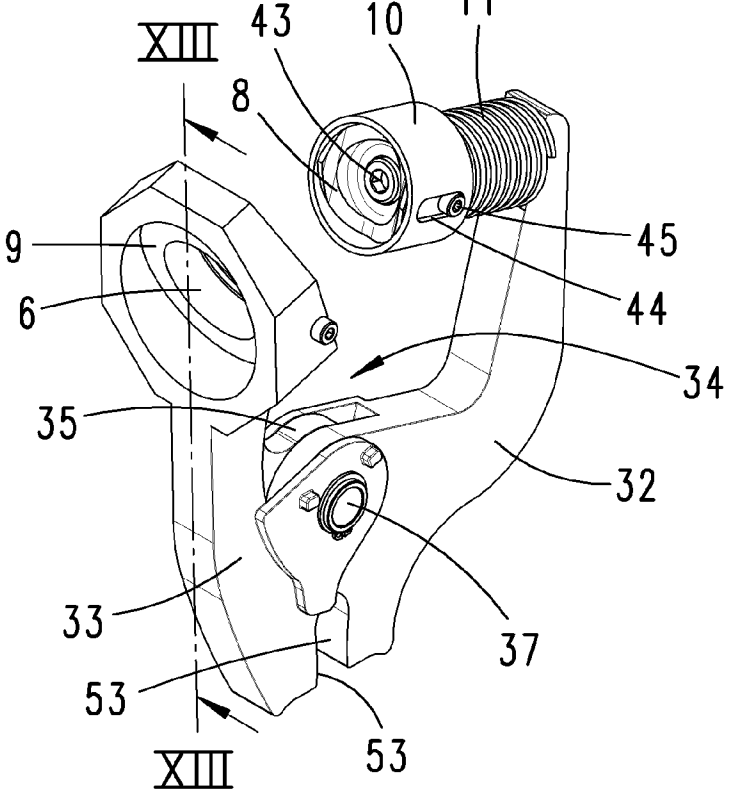
FIG. 12 shows another perspective view according to FIG. 7, without a device adapter.

FIGS. 12 and 13 show in perspective and cross sectional views, respectively, the arrangement of the jaws without the connecting fitting and in their open position.

Figure 16:
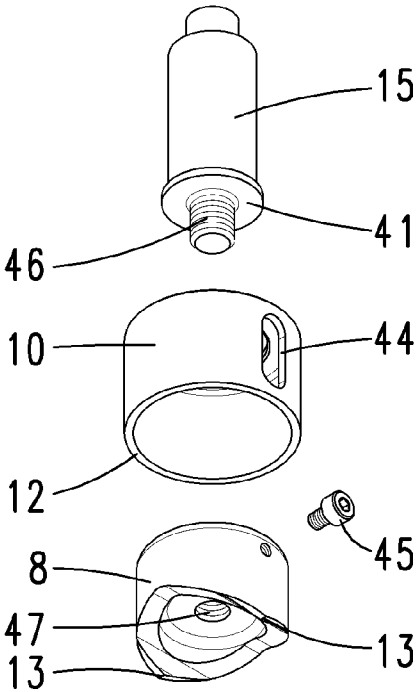
FIG. 16 shows an exploded illustration of the punch having a stripper part according to FIG. 15.
Figure 15:
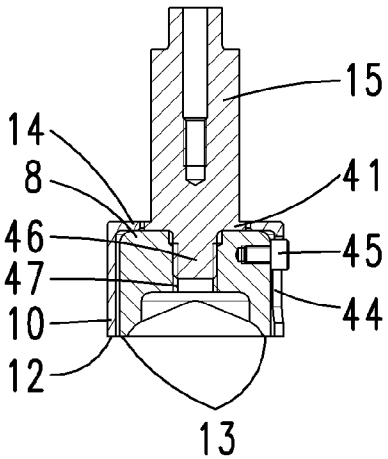
FIG. 15 shows a cross section of the punch having a stripper part of a second embodiment.
Figure 14:
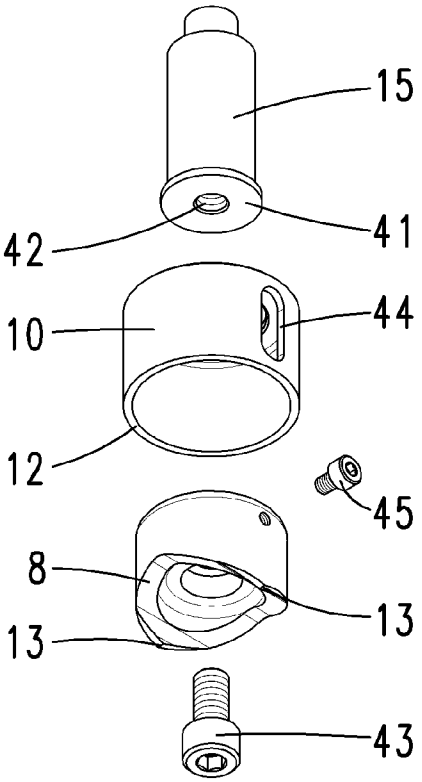
FIG. 14 shows an exploded illustration of the punch having a stripper part of a first embodiment.

With respect to FIGS. 14 to 16, the design of the punch 8 and its mounting are also explained in further detail with regard to two possible embodiments.

The embodiment shown in FIG. 4, for example, is depicted in an exploded illustration in FIG. 14. The mount part 15 has a plate formation 41 on the punch end, protruding beyond the cylindrical mount part 15 transversely with respect to a longitudinal extent of the mount part 15. The largest possible surface for support of the mount part 15 on the facing rear side of the punch 8 is provided. An upper stop for compression spring 11 may also be formed in this way.

This plate formation has a central screw opening 42, in which a securing screw 43 engages, the securing screw passing through the punch 8 and thus securing it on the mount part 15.

The stripper part 10 is mounted on the punch 8 on the one hand by means of an elongated hole 44 and a screw 45, which engages therein, and on the other hand by the undercut bottom portion 14. This is advantageous during assembly, for example, when the mount part 15 is not yet connected to the securing part 16 and therefore the compression spring 11 does not yet have any counter support.

The further embodiment according to FIGS. 15 and 16 differs from the embodiment described above, in that at the same time a screw-shaped protrusion 46 is formed on the mount part 15 facing the punch 8. The punch 8 has a threaded opening 47, which fits the former, so that the two parts can be screw-connected.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

LIST OF REFERENCE NUMERALS

1 Pressing device
2 Return valve
3 Tank
4 Pump ram
5 First jaw
6 Punching opening
7 Second jaw
8 Punch
9 Punch insert
10 Stripper part
11 Compression spring
12 Bordering edge
13 Punch tips
14 Bottom portion
15 Mount part
16 Securing part
17 Housing
18 Sliding device
19 Piston part
20 Cylinder part
21 Return spring
22 Receptacle
23 Device
24 Connecting line
25 Bottom borehole
26 Recess
27 Cross bolt
28 Base
29 Elongated holes
30 Connecting fitting
31 Attachment part
32 Pivoting jaw
33 Pivoting jaw
34 Pivot joint
35 Bearing eye
36 Bearing eye
37 Mounting bolt
38 Arm
39 Arm
40 Mounting neck
41 Plate formation
42 Screw opening
43 Securing screw
44 Elongated hole
45 Screw
46 Protrusion
47 Threaded opening
48 Mount
49 Connecting fitting
50 Piston part
51 Return spring
52 Roller
53 Acting surfaces
54 Compression spring
L Length
D Diameter
α Angle

The invention claimed is:

1. A jaw pair configured to punch holes or recesses in a workpiece, the jaw pair being connectable to a device, comprising:

a first jaw having a punching opening formed thereon;

a second jaw moveable relative to the first jaw;

a mount extending from the second jaw, the mount being formed of a body having a plate extending outwardly from the body, the plate having a dimension which is larger than the body;

a punch extending from the plate of the mount, the punch formed from a wall having first and second ends and an outer contour extending between the first and second ends, the second end of the punch defining a punch tip;

a stripper part comprising a side wall having first end and an opposite second end and a bottom wall at the first end of the side wall, the bottom wall having an opening therethrough, the bottom wall extending behind the first end of the punch, the plate of the mount seated within the opening in the bottom wall, the second end of the side wall forming an opening, the side wall surrounding the outer contour of the punch and the punch configured to extend through the opening formed by the second end of the side wall, the stripper part being moveable relative to the punch and relative to the mount; and a spring having a first end and an opposite second end, the first end of the spring engaging the second jaw, and the second end of the spring configured to be engaged with the bottom wall of the stripper part and configured to be engaged with the plate of the mount, the spring being configured to bias the stripper part toward the punching opening, the stripper part being moveable relative to the punch and relative to the mount to compress the spring, wherein the second end of the spring engages with the plate of the mount and the bottom wall of the stripper part in a first position, and the second end of the spring engages with the bottom wall of the stripper part and does not engage with the plate of the mount in a second position.

2. The jaw pair according to claim 1, wherein a front edge of the stripper part is biased by the spring into a position protruding at least partially beyond the punch tip of the punch.

3. The jaw pair according to claim 2, wherein the spring surrounds the body of the mount.

4. The jaw pair according to claim 1, wherein the spring surrounds the body of the mount.

5. The jaw pair according to claim 1, wherein the punching opening has a metal insert mounted therein configured to receive the punch therein.

6. The jaw pair according to claim 1, further including a vertical handle, and wherein the first and second jaws are formed differently, the second jaw having an angled shape in a side view which is formed by a first generally horizontal portion extending from the handle and a second generally vertical portion extending from the first generally horizontal portion.

7. The jaw pair according to claim 1, in combination with a hydraulically operated device, the device being connected to the jaw pair.

8. The jaw pair according to claim 1, wherein the mount is separately formed from the second jaw and attached thereto.

9. The jaw pair according to claim 1, wherein the second jaw is pivotally connected to the first jaw.

10. The jaw pair according to claim 1, wherein the second jaw is slidably connected to the first jaw.

11. The jaw pair according to claim 1, wherein the punch is separately formed from the mount and attached to the mount.

12. The jaw pair according to claim 11, wherein the mount includes an opening into which a fastener is secured, the fastener securing the punch to the mount.

13. The jaw pair according to claim 11, wherein the mount includes a protrusion to which the punch is attached.

14. The jaw pair according to claim 13, wherein the protrusion is threaded and the punch is threadedly attached thereto.

15. The jaw pair according to claim 1, wherein the mount is separately formed from the second jaw and attached thereto, and the punch is separately formed from the mount and attached to the mount.

16. The jaw pair according to claim 15, wherein the mount includes an opening into which a fastener is secured, the fastener securing the punch to the mount, the fastener being detachable from the mount to detach the punch from the mount.

17. The jaw pair according to claim 15, wherein the mount includes a protrusion to which the punch is configured to be attached and configured to be detached.

18. The jaw pair according to claim 1, wherein the punch is detachable from the mount, and wherein the second end of the spring is engaged with the plate of the mount when the punch is detached from the mount.

19. The jaw pair according to claim 18, wherein the mount includes an opening into which a fastener is secured, the fastener securing the punch to the mount, the fastener being detachable from the mount to detach the punch from the mount.

20. The jaw pair according to claim 18, wherein the mount includes a protrusion to which the punch is configured to be attached and configured to be detached.

* * * * *